United States Patent [19]

Petit

[11] 4,444,244

[45] Apr. 24, 1984

[54] APPARATUS FOR CONTINUOUS CASTING ON A GROOVED WHEEL

[75] Inventor: Robert Petit, Ugine, France

[73] Assignee: Ugine Aciers, Paris, France

[21] Appl. No.: 374,780

[22] Filed: May 4, 1982

[30] Foreign Application Priority Data

May 15, 1981 [FR] France ..... 81 10098

[51] Int. Cl.[3] ..... B22D 11/06

[52] U.S. Cl. ..... 164/429; 164/433

[58] Field of Search ..... 164/479, 482, 433, 434, 164/427, 429

[56] References Cited

U.S. PATENT DOCUMENTS

| | | | |
|---|---|---|---|
| 2,745,151 | 5/1956 | Brennan | 164/479 |
| 3,999,914 | 12/1976 | Breher et al. | 164/434 X |
| 4,211,271 | 7/1980 | Ward | 164/433 X |

FOREIGN PATENT DOCUMENTS

| | | | |
|---|---|---|---|
| 42-6961 | 3/1967 | Japan | 164/433 |

*Primary Examiner*—Kuang Y. Lin

*Attorney, Agent, or Firm*—Dennison, Meserole, Pollack & Scheiner

[57] ABSTRACT

A method and apparatus are set forth relating to casting of metals with a high melting point utilizing a casting wheel having a grooved rim into which liquid metal is introduced. The metal is sealed during solidification by means of movable flaps which move with the wheel during its rotation. Cooling device and device for positioning of the flaps are provided and the apparatus provides for manufacture of bars or strips of ferrous or non-ferrous metals which are free from sharp edges and burrs.

7 Claims, 9 Drawing Figures

APPARATUS FOR CONTINUOUS CASTING ON A GROOVED WHEEL

The method and apparatus according to the invention are very generally concerned with the continuous casting of metals on a wheel.

The method and apparatus enable metals or alloys to be cast continuously in the form of bars or strips. The method can be applied to a very wide range of metals or alloys. Although it can be used effectively for casting metals with a relatively low melting point, such as aluminum, it is particularly well suited to the casting of metals with a high melting point, such as copper and its alloys and, above all, the group of ferrous alloys, ordinary, alloyed, stainless and refractory steels. It is also suitable for casting other refractory metals or alloys such as superalloys.

The description and figures which follow explain the features of the method of the invention. In the drawings.

Figures 1, 2:
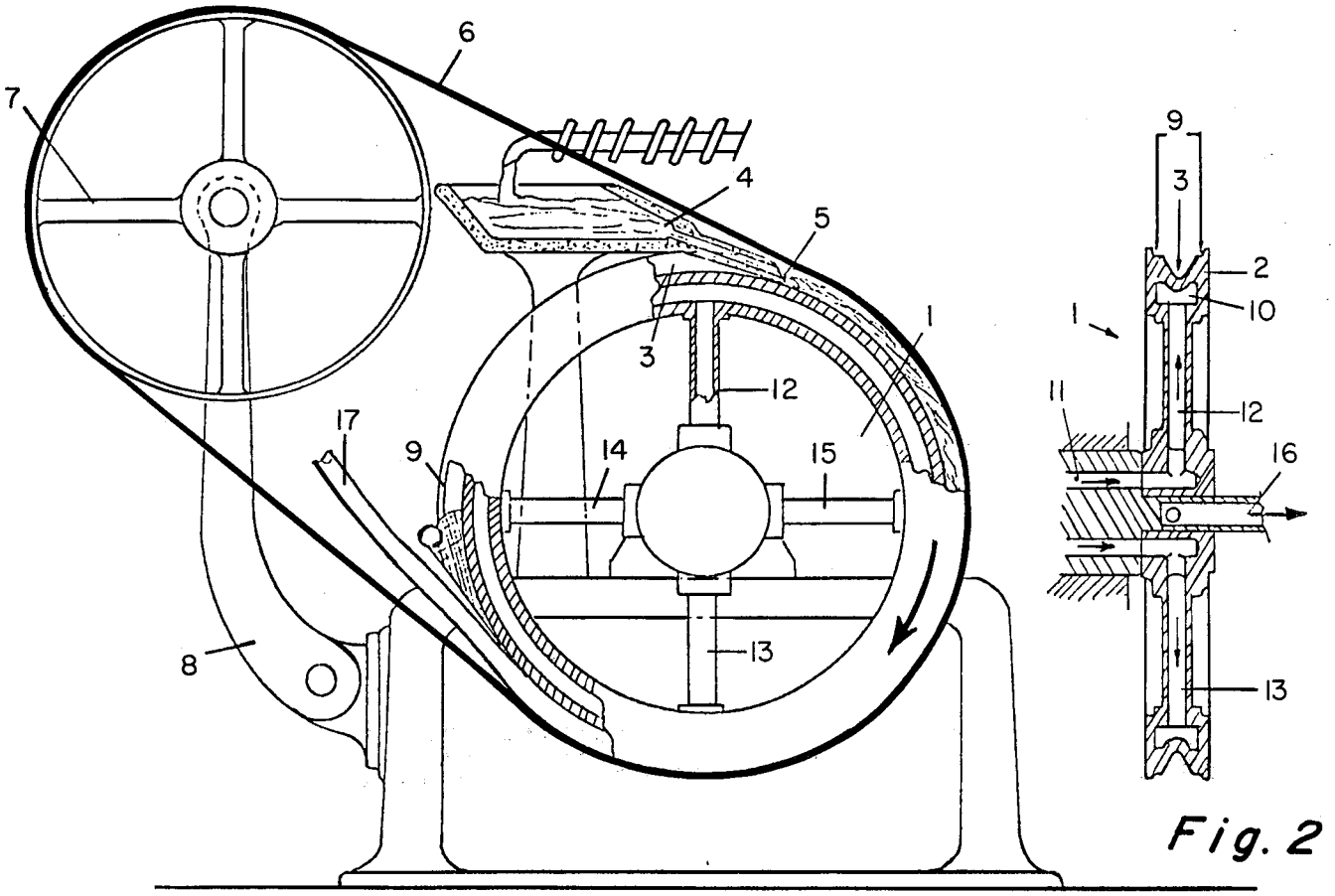
FIG. 1 shows a known prior art apparatus for continuous casting on a wheel, with the rim closed by an endless metal band.
FIG. 2 shows a detail of the wheel in FIG. 1.

French Pat. No. 981 897 describes a method of continuous casting on a wheel. FIGS. 1 and 2 show the characteristics of this process, which is now well known. A wheel (1), which is rotated slowly by a motor (not shown), has a hollow rim (2) in which a groove (3) is formed. A feed means (4) dispenses the liquid metal into the groove (3) at (5) by means of a nozzle.

An endless metal band (6) is wound onto the casting wheel and onto a free wheel (7) arranged in the same plane. The free wheel is mounted on an oscillating arm (8) which acts as a tightener. The band is thus applied to the edges (9) of the rim of the wheel (1) and therefore prevents the metal cast at (5) from coming out of the groove. The rim is cooled by water circulating in the space (10), thus enabling the metal to solidify rapidly in the groove. The water is let in through the axle of the wheel at (11), then sent into the space (10) through diametrically opposed spokes (12) and (13). It is returned through two other spokes (14) and (15) and through the axle of the wheel at (16). The wheel turns in the direction of the arrow, and the metal band is pressed onto the rim in such a way that there is no appreciable slipping. The metal solidifies in the groove at a relatively high speed, and the solidified bar (17) is extracted continuously from the groove, at the place where the metal band leaves the rim before being wound about the wheel (7). It will be seen that the bar (17), which is thus formed continuously, has to be diverted from the plane of symmetry of the rim (2), sufficiently to bring it out of the space bounded by the wheels (1) and (7) and the band (6) without contacting the band. Such diversion does not raise any special difficulties in the case of bars of small section, made of a metal of limited hardness. On the other hand it is more difficult with bars of large section, relatively broad strips, or with hard metals or alloys.

Figure 3:
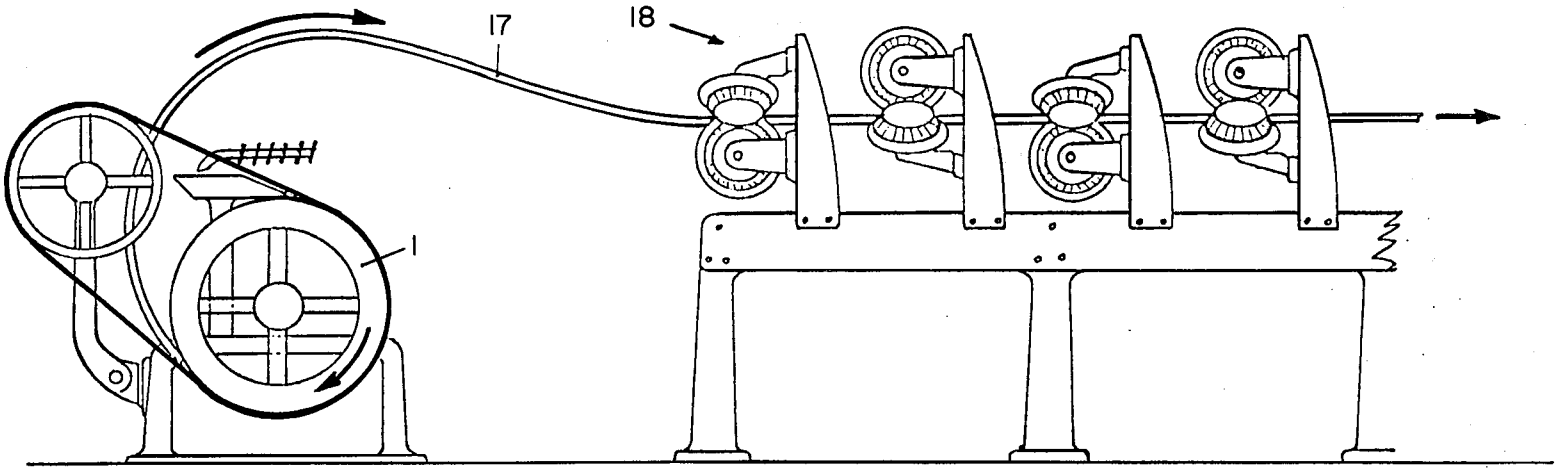
FIG. 3 shows a unit comprising the FIG. 1 apparatus and a continuous rolling installation associated with it in a manner known in the prior art.

FIG. 3, which still follows the teaching of the abovementioned patent, shows the bar (17) extracted from the casting wheel (1). The bar is thus diverted from the plane in which it leaves the wheel, then sent to a continuous rolling installation (18).

As a means of overcoming the disadvantage of diverting the bar in this way, French Pat. No. 1 178 580 proposes that the band or belt used to seal the rim should travel, not over a single free wheel acting as a tightener, but over at least two free wheels.

Figure 4:
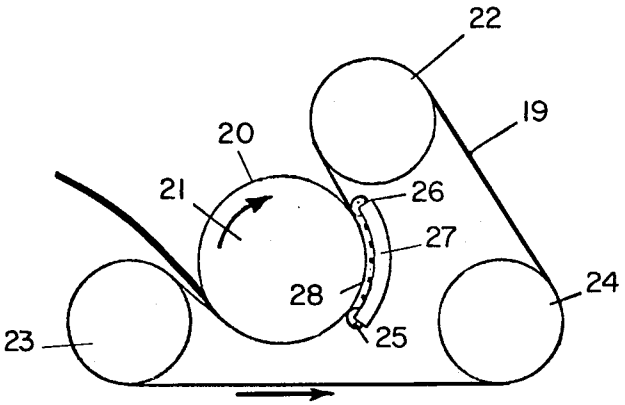
FIG. 4 shows an apparatus for continuous casting on a wheel, which is also known, where the metal band is wound onto guide pulleys.

FIG. 4 shows an arrangement proposed in that patent, in which the endless metal band (19), which closes the hollow rim (20) of the casting wheel (21), is wound over two guide pulleys (22) and (23) and a tensioning pulley (24). Pressure rollers (25) and (26) are used to improve contact between the metal band and the edges of the rim. In addition, as a means of improving the cooling of the metal band, a movable support (27) is provided with sprinkling means (28), which project water onto the visible face of the band.

Many modifications have been proposed to the method just described of continuous casting on a wheel. However, experience has shown that, although the process is well suited to continuous casting of metals with a relatively low melting point, such as aluminum, it is far more difficult to use when casting metals with a much higher melting point, such as copper or such as steel. It then becomes more and more difficult to obtain satisfactory cooling of the metal band which closes the rim. For reasons of mechanical properties, the band is generally made of steel, and if it is insufficiently cooled there is a danger (a) that it will be attacked by the liquid metal with which it comes into contact and (b) that it will lose some of its mechanical resistance properties through annealing. In addition, the alternating torsional strains to which the band is subjected may cause transverse cracking even in the short term, and finally, the sprinkling of the outer face of the band, which is virtually necessary in all cases, is not without its dangers. It can in fact happen that the water thus projected comes into contact with the liquid metal which is cast in the rim. There is then a danger of explosions taking place; in most cases these will break the metal band and may also cause very serious damage to the casting wheel.

Finally, a serious defect of products obtained by casting bars on a wheel rim, which is sealed by a metal band, is the presence of two sharp edges on the solidified product, at the place where the two edges of the band meet the side walls of the rim. These sharp edges are a cause of defects, and it is very often necessary to subject the bar extracted from the rim to burring before passing it into the rolling mill.

Research has therefore been carried out into the possibility of extending the application of casting on a wheel to all kinds of metals or alloys, particularly those with a high melting point, and of obviating of the limitations at present applied to the use of this casting method, particularly by the available means for sealing the rim.

The method and apparatus according to the present invention do in fact make it possible to dispense with these limitations.

The apparatus according to the invention is in the form of a casting wheel comprising a grooved rim, which is sealed by movable flaps which accompany the wheel in its rotation and remain at a specific location along the rim; the opening or closing of the flaps is controlled by means which allow the flaps to close in the zone where the liquid metal is introduced and open in the zone where the solidified bar or strip is extracted. Advantageously the flaps have a cooling means, operating by internal circulation of water, and in addition gripping means ensure that the flaps are applied to the rim of the wheel with sufficient pressure. Finally, connecting means enable the flaps to be interlocked.

An embodiment of the apparatus according to the invention will now be described in much greater detail.

Figure 5:
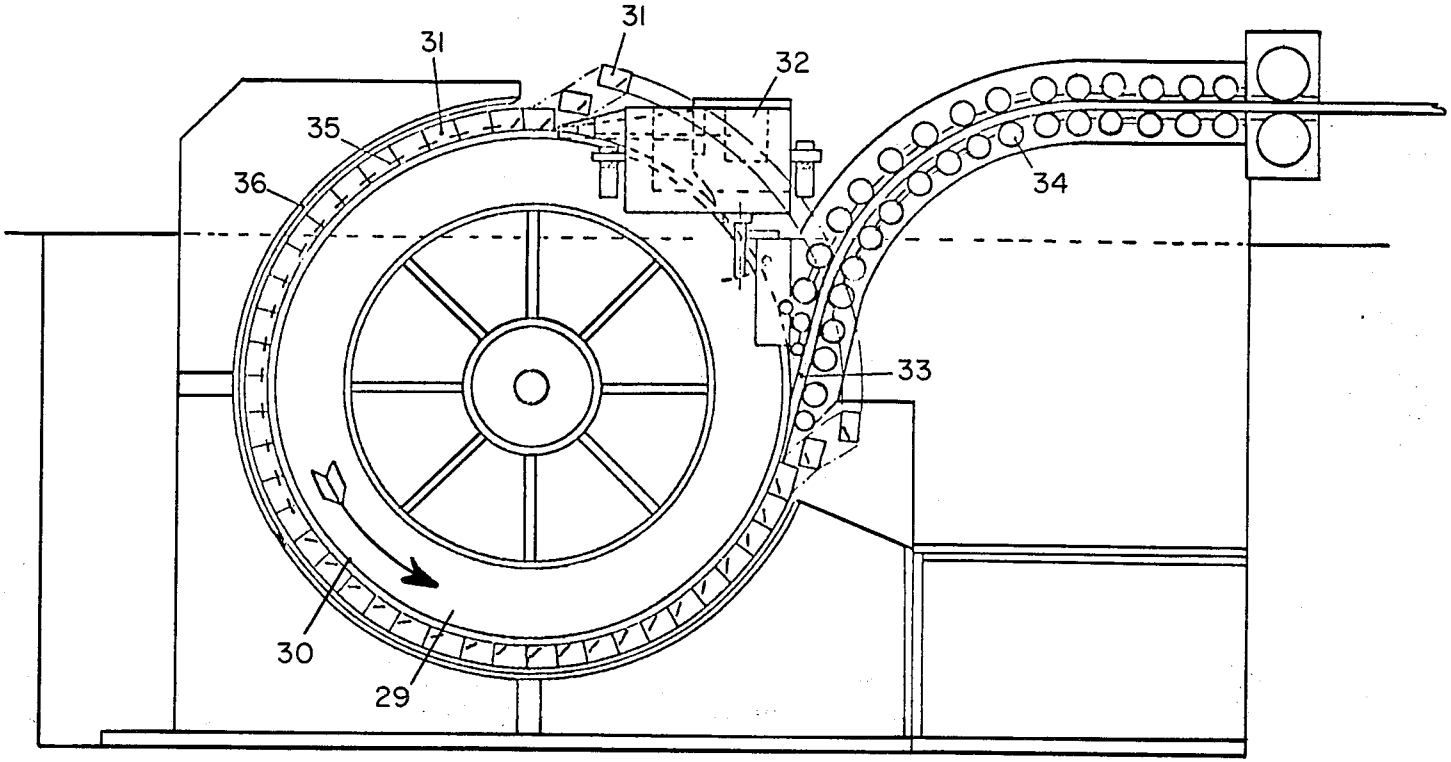
FIG. 5 shows an apparatus for continuous casting on a wheel, where the rim is closed by flaps according to the present invention.

FIG. 5 shows a casting wheel (29) which is driven by a motor (not shown); the wheel turns in the direction of the arrow, and its rim (30) is equipped with movable flaps such as (31). As shown in the figure, the flaps (31) bear on the edges of the rim in an angular zone located between the point where the liquid metal is inserted in the groove by a feed means (32), to a point near that where the solidified bar or strip (33) is extracted from the groove by a suitable means such as guiding rollers (34). Throughout the zone extending from the point where the solidified bar is extracted and the point where the liquid metal is inserted, the flaps are in the open position and arranged so that they do not hinder the operation of the extraction means, so that they do not impede the passage of the solidified bar or strip, which is generally directed towards the means for reducing it, e.g. by rolling, and so that they also do not interfere with the operation of the means for feeding in the liquid metal.

An essential feature of the invention is that the movable flaps (31) remain at a specific location along the rim of the wheel during its rotation. Connecting hooks (35), shown diagrammatically in FIG. 5, hold the flaps against one another, to prevent any leakage of liquid metal through any space left between adjacent flaps. As will be explained below in greater detail, a stationary ramp (36) surrounds the casting wheel throughout the angular region where the flaps have to remain closed; it ensures that the flaps are applied to the edge of the rim, with the aid of a conventional gripping means.

Figure 6:
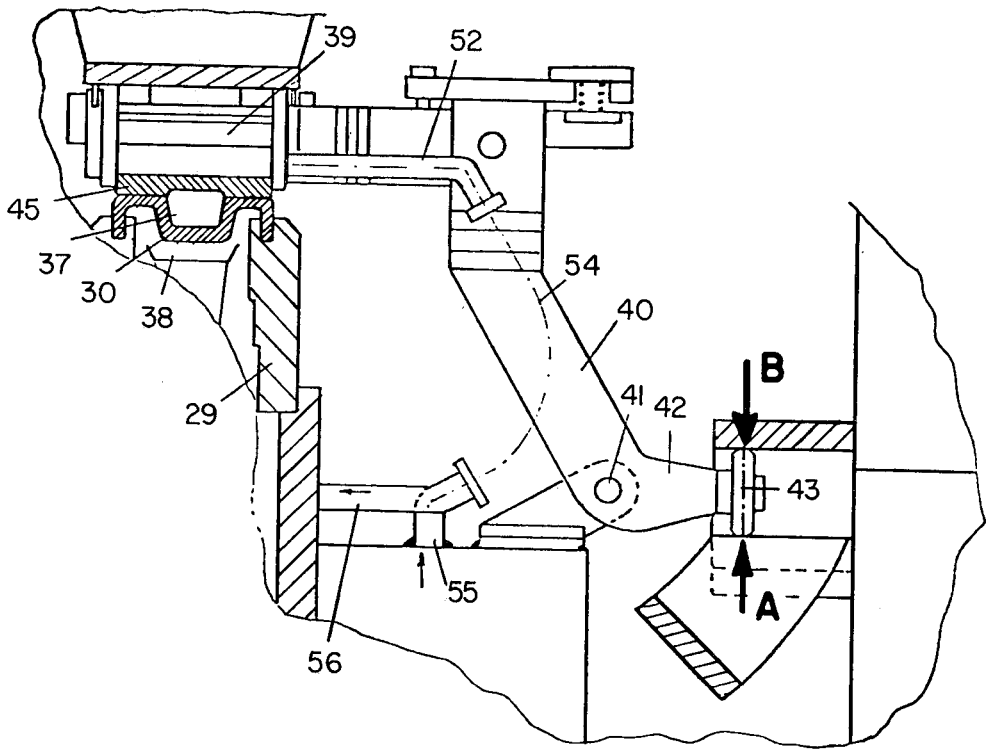
FIG. 6 is a view of the rim of the casting wheel and of a flap according to the invention, in the closed position.

An advantageous embodiment of the flaps according to the invention can be seen in detail from FIG. 6.

The casting wheel (29), which is shown partly in a cross-section taken in a plane parallel with the axle, has a rim (30) provided with a groove (37), designed to receive the liquid metal and allow it to solidify. The rim is cooled by circulation of water. This takes place in known manner in the annular space (38) and is kept up by a water intake and discharge system, which may e.g. take effect through the axle of the wheel; this is hollow, and in known manner has the necessary connections with the external network. The flap (39) is an assembly which is connected to the pivot spindle (41) by means of a bell crank arm (40). The spindle (41) is itself fixed in a fork joint which is rigidly connected to the structure of the casting wheel in the vicinity of the rim. The arm (40) is extended beyond the spindle (41) by a lever portion (42) with a roller (43) fixed on it.

It will be seen that, if upwardly directed forces (arrow A) or downwardly directed forces (arrow B) are applied to the roller, they will act on the lever (42), and this will either keep the flap (38) with its cover plate (45) bearing on the edges of the rim (30), or else raise the flap.

Figure 7:
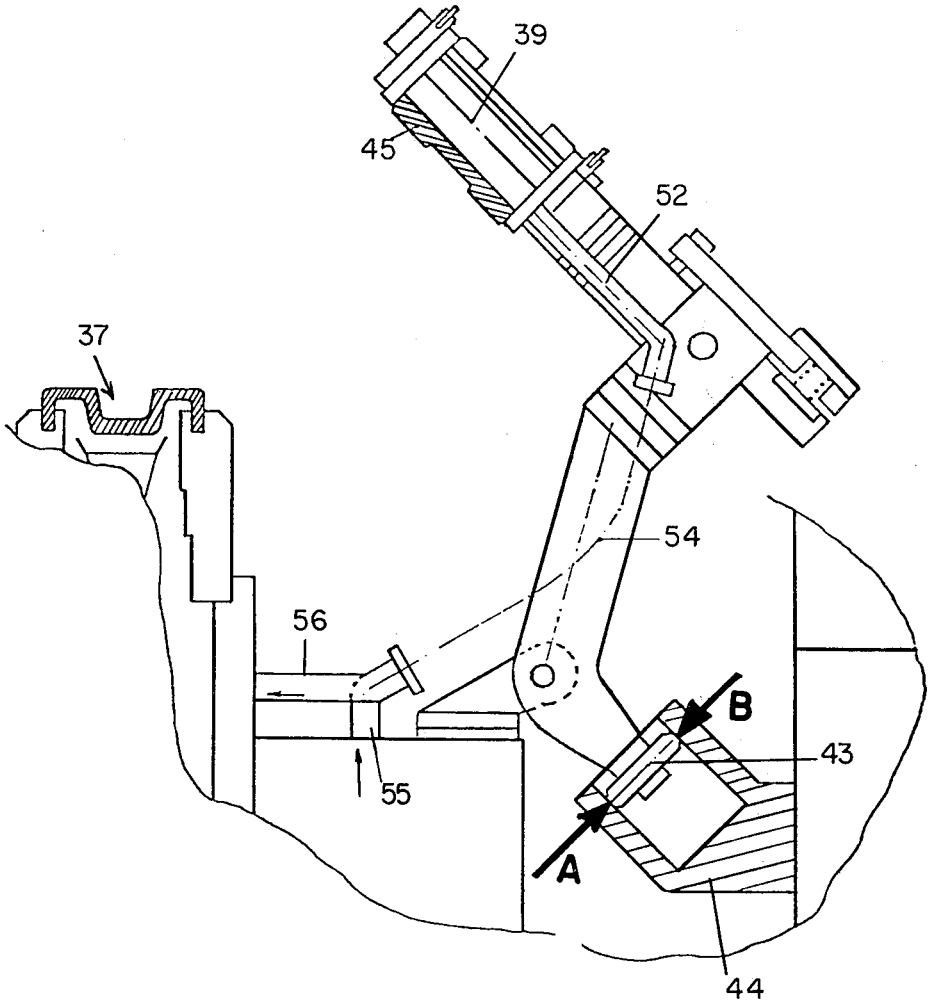
FIG. 7 is a view of a flap according to the invention in the open position.

FIG. 7 shows the flap (39) in the open position. It will be seen that the space above the groove of the rim is then completely exposed, enabling means for extracting the solidified bar or a means for inserting the liquid metal or alloy to engage in the groove in specified zones.

In practice, the opening and closing of each flap is brought about for a very specific angular position relative to the frame (FIG. 7) by means of stationary ramps rigidly connected to the frame on which the casting wheel is mounted. The ramps have a profile designed for moving the rollers (43) upwards or downwards at the desired angle.

It will be appreciated that it is absolutely necessary to seal the groove tightly, in order to prevent any leakage of liquid metal, causing wastage of metal and above all surface defects. For this purpose it is possible, as a complementary step, to improve the centering of the flap relative to the groove, and also to ensure (a) that the flap is applied to the groove with sufficient pressure and (b) that successive flaps are held against one another by a connecting means such as hooks.

Figure 8:
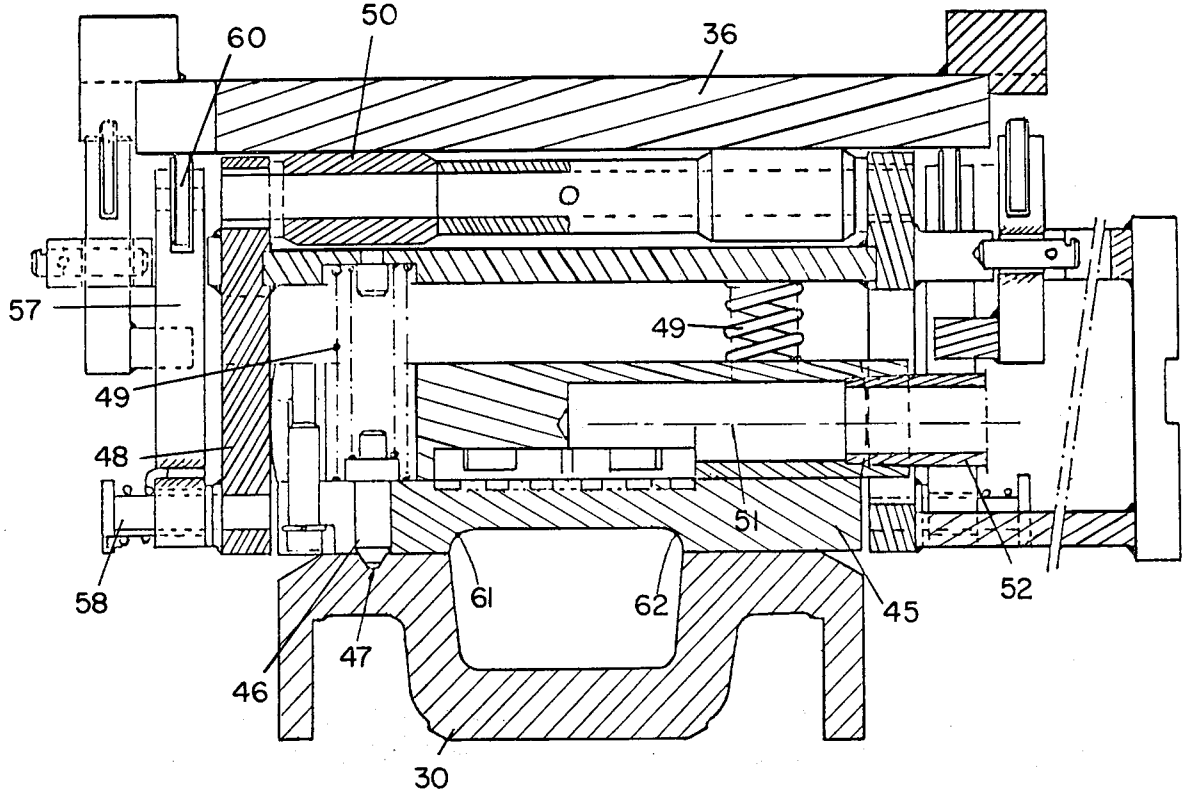
FIG. 8 is a detail of a flap according to the invention, bearing on the rim of the casting wheel.

It will be seen from FIG. 8 that the cover plate (45) of the flap, shown in cross-section, is centered relative to the rim (30) by pins such as (46). These centering pins, which are joined to the cover plate (45), enter recesses such as (47) provided in the rim (30) when the shutter is swung down and brought to bear on the rim. In this way the cover plate (45) is positioned in a reproducible manner each time it comes to bear on the rim (30). A resilient gripping means is further used to ensure that the cover plate is constantly pressed onto the rim.

As shown in the figure, each flap has a casing (48) with the cover plate fixed resiliently inside it by springs such as (49). At the upper part of the casing there are rollers such as (50). When each flap has been closed, near the point where the groove is filled with liquid metal, the flaps enter a space bounded by a stationary annular ramp (36) concentric with the wheel, against which the rollers (50) roll. The distance between the ramp and the rim of the casting wheel is calculated so that the springs (49) are compressed by means of the rollers (50). The cover plate is thus applied to the rim with sufficient force. This embodiment makes it possible to absorb expansion and any excess thickness caused by the liquid metal overflowing.

FIG. 8 also shows how each cover plate is equipped with an internal cooling means (51). Since water is most commonly used as the cooling fluid, it will be appreciated that the use of flaps hinged directly onto the casting wheel makes it extremely easy to supply fluid from the wheel itself, the wheel being supplied without difficulty through fluid inlets and outlets at the level of its axle.

Figure 9:
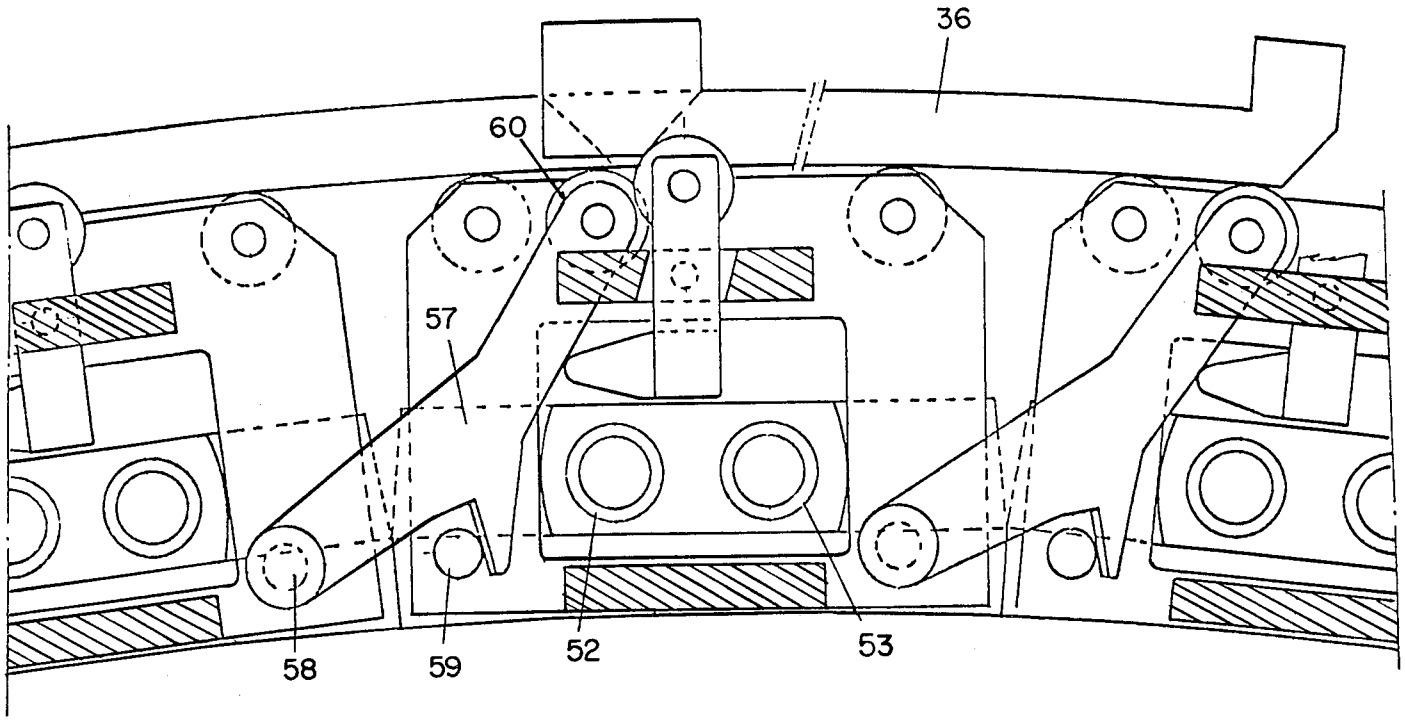
FIG. 9 is a view showing the interengaging of the flaps according to the invention.

Referring to FIGS. 6 and 8, the cover plate (45) has a double wall with water passages (51) provided inside it. Inlet (52) and outlet (53) connections for the water (FIGS. 6, 7, 8 and 9) are joined by flexible connecting tubes, e.g. made of elastomer and indicated at (54), to corresponding water inlets and outlets such as (55–56), which are provided on the lateral face of the casting wheel not far from the point where the pivot pin (41) is fixed. The length of the connecting tubes is such that it does not hinder the swinging movement of the flap. Finally, a system for hooking successive flaps onto one another is shown in FIG. 9. It will be seen that each flap has a catch (57) hinged around a pin (58), which is adapted to be hooked onto a stud (59). The opening and closing of the catch are controlled by a roller (60), which is raised or lowered by appropriately located abutments. The resultant connecting means avoids any leakage of liquid metal between the cover plates.

By using flaps of relatively small dimension and compact structure, hinged separately onto the actual casting wheel, it becomes possible for the cover plate to be made of those metals which are most appropriate to tolerate direct contact with the metal which has to be cast. Thus it will be possible for the cover plate to be made of metals of high specific heat and/or high heat conductivity, such as aluminum, magnesium, copper, silver or some alloys of these metals. It will generally be preferable to make the cover plate of the same metal as the rim, that is to say, in most cases of copper or alloys containing a large quantity of copper. In many cases only the inside wall of the cover plate which is in contact with the liquid metal will be made of a highly conductive metal. The second, outside wall of the cover plate may be made of a metal with much more mechanical strength. Since the cover plate is cooled vigorously by a fluid, there is virtually no deformation due to differential expansion. The dimensions of the cover plate are calculated to allow for expansion of the rim when in use, in order to avoid leakage of liquid metal.

With the embodiment designed to close the casting wheel it is possible to envisage a very important change in the profile of the bars or strips cast by this process. When the metal is cast on a conventional wheel with the groove closed by a metal band, the angle formed between the inner face of the metal band and the side walls of the groove is approximately 80°. This results from the need to have a clearance of approximately 10° to 20° so that the bar can be removed from the groove. Furthermore, there cannot be any rounding at the top of this angle and it is therefore sharp. Moreover as the walls of the groove gradually become worn, there is a danger of small quantities of liquid metal infiltrating between the band and the edge of the rim; these provide an additional reason for carrying out deburring.

With the invention, on the other hand, the rigidity of the cover plates, which are virtually indeformable, makes it possible to provide a profile complementary to that of the groove on the surface of the plates facing towards the rim.

A cover plate (45) of this type, with rounded portions (61) and (62) can be seen from FIG. 8. With the aid of these rounded portions, the bar which will be cast in the rim will have exclusively rounded edges, and can thus be rolled under Particularly favorable conditions.

The coupling between the cover plate and the rim is thus formed on the side surfaces of the bar and, owing to the centering arrangements used, no relative transverse displacement is observed between the cover plate and the rim.

The invention concerns not only the casting apparatus just described but also a method of casting metals or alloys with a high melting point on a wheel, such as copper and its alloys, steel and other metals or alloys with a high melting point.

The method makes it possible to obtain very rapid solidification of the metals or alloys cast, due to the closing of the rim in the casting zone, by means of flaps which are cooled by circulating a fluid such as water.

This thus reduces the danger of segregation and gives rough cast metal structures with a particularly fine grain. The process also produces cast bars with a cross-section free from any sharp edges, thereby avoiding the dangers of formation of folds and a near-round shape can even be obtained.

Different means for supplying liquid metal to the casting wheel may be envisaged from one case to another. Nozzles may be used in particular, or channels at a substantially constant level.

In cases where oxidisable metals such as copper are being cast, the means for supplying the liquid metal may be put into a controlled atmosphere.

Many variations of the apparatus according to the invention may be produced and will be covered by the invention.

I claim:

1. In an apparatus for use in continuous casting of metals and alloys in bar or strip form, including a rotary casting wheel, said wheel having a grooved rim and means for closing the rim along a portion of its periphery, means for introducing liquid metal into said groove and means spaced about the periphery for extracting the solidified continuous stock, the improvement comprising said closing means being in the form of a plurality of movable flaps (31, 39), each pivotally mounted on the casting wheel so that each flap is fixed in location along the rim (30) of the wheel during its rotation, means (44, 36) for opening and closing the flaps so that the flaps are in the closed position between the point of liquid metal introduction and solidifed metal extraction, and are open from the extraction point to the introduction point.

2. Apparatus as defined in claim 1 wherein said means for opening and closing said flaps comprises a stationary ramp (44) fixed on a frame which supports the casting wheel for rotation.

3. Apparatus as defined in either of claims 1 or 2 and further including recess means (47) provided in said rim, each movable flap having a rigid cover plate (45), a pin (46) on each cover plate adapted to seat in said recess means whereby said cover plate is centered relative to the rim when the respective flap is swung down to bear on said rim.

4. Apparatus as defined in claim 3, wherein each flap includes a casing (48), spring means (49) and roller means (50) fixed on the upper part of said casing, said cover plate being fixed resiliently inside said casing by said spring means and roller means, a stationary annular ramp (36) concentric with said casting wheel on which said roller means rides, so that when said flap has been closed its roller means will serve to compress said spring means so that said cover plate is biased against said rim.

5. Apparatus as defined in claim 1 and further including, means for holding adjacent flaps against each other when they are closed consisting of a catch (57) hingedly mounted on a pivot pin (58) on each flap, a stud on each flap adapted to be engaged by the catch on the adjacent flap, fixed abutment means, and catch roller means (60) attached to each catch and adapted to be raised and lowered by contact with said abutment means to control opening and closing of said catch.

6. Apparatus as defined in claim 3 wherein the cover plate is formed with a double wall having passages (51) therein for circulation of cooling liquid, inlet and outlet connections (52,53) for said cooling liquid on the lateral face of the flaps.

7. Apparatus as defined in claim 3 wherein the surface of each cover plate (45) facing the rim (30) has a profile complementary to that of the groove and is provided with rounded portions (61, 62) so that the solidified metal will have rounded edges.

* * * * *